United States Patent [19]

Smith

[11] Patent Number: 4,543,734

[45] Date of Patent: Oct. 1, 1985

[54] TREATMENT OF WATER DAMAGED CELLULOSIC MATERIALS

[76] Inventor: Richard D. Smith, 224 Early St., Park Forest, Ill. 60466

[21] Appl. No.: 591,027

[22] Filed: Mar. 19, 1984

[51] Int. Cl.[4] ..... F26B 5/06

[52] U.S. Cl. ..... 34/5

[58] Field of Search ..... 34/5

[56] References Cited

U.S. PATENT DOCUMENTS 2,444,124 6/1948 Wedler ..... 34/5

3,681,851 8/1972 Fleming ..... 34/5

OTHER PUBLICATIONS

Utilization of Freeze-Drying to Save Water-Damaged Manuscripts, in letter to the Editor, by James M. Flink, Vacuum/vol. 22, No. 7, Jul. 1972, Pergamon Press Ltd./printed in Great Britain.

*Primary Examiner*—John J. Camby

*Attorney, Agent, or Firm*—Fitch, Even, Tabin & Flannery

[57] ABSTRACT

A process for treating water damaged cellulosic materials, particularly books, is provided, which process comprises freezing the water throughout the extent of the cellulosic materials and subliming the water from the materials to dryness at temperatures below freezing. The process can provide effective fumigation of cellulosic materials.

20 Claims, No Drawings

TREATMENT OF WATER DAMAGED CELLULOSIC MATERIALS

BACKGROUND OF INVENTION

Our society suffers both great intellectual and property loss through the destruction of books, periodicals, records, works-of-art on paper, and personal memorabilia, generally referred to herein as cellulosic materials, as a consequence of wetting by water. This wetting can involve hundreds of thousands of books during natural disasters like floods, windstorms, and fires (from water used in fire fighting). Unfortunate mishaps like leaky roofs, malfunctioning sprinkler outlets, dripping pipes, defective window wells and drainage systems regularly soak hundreds of books. At best, generally speaking, the covers are lost, the books are defaced, and their dried remains are totally useless for their intended purposes.

This tragic loss is a persistent problem that has not been solved, even though many techniques have been developed and are being applied in efforts to minimize the loss. For example, books may be dried manually by pressing water from them, placing blotter papers between pages and pressing again, and subsequently standing the books open for air drying. This technique is unsatisfactory, with the cellulosic materials beginning to mildew after a short time, and in the case of books, their drying crooked and warped.

Books have been dried with hot air in low temperature ovens, but this technique produces significant warpage and distortion, loss of covers, and likewise requires considerable skilled labor, plus the expense of rebinding, to restore them. The known air-drying techniques do not prevent the leaves of books made from coated paper from sticking together to such a degree that they cannot be separated and the entire book is unsalvageable.

Wetted books can also be taken apart and dried leaf by leaf. However, the cost per book is beyond the reach for most libraries, due to the skilled hand labor required to take the book apart, dry and flatten the pages, and rebind the book.

The best technique available today is considered to be drying books by vacuum freeze-drying. The large vacuum freeze-dryers needed for major catastrophies are only available as the large vacuum dryers built for space exploration in the 1960's and 70's. Such equipment is only known to be available in the Washington, D.C., Valley Forge, Pa., St. Louis, Mo., Los Angelos, Calif., San Francisco, Calif., and Seattle, Wash., areas. These vacuum dryers are not readily transportable, are available only when not in use for other purposes, and are virtually never available for the small routine mishaps that regularly occur. Vacuum freeze-drying capability is difficult to provide. The equipment is expensive, requires highly trained operators, and does not have built-in freezing capability. The library personnel must have the books frozen locally, stored temporarily, packed for shipment, shipped, and then prevention from thawing must be maintained. The potential for further damage is great, but the cost is so high and frequency of use of vacuum freeze-drying equipment is so low that regional groups of libraries cannot afford it.

Moreover, vacuum freeze-drying involves loading previously frozen books and bringing them to complete dryness without the possibility of intermittent straightening and adjustment to insure the books dry straight and to save the book bindings. Generally, the book comes out in the same shape it goes in. If the book is frozen crooked, it dries crooked and must be taken apart, its leaves flattened, put back together again and rebound. This not only adds greatly to the cost, but also makes the books unavailable to readers for months or even years.

The magnitude of this problem can be seen from the fact that, on average, three major fires occur each year in American research libraries with great loss of books and records from water damage. Librarians and archivists fear water damage from fire fighting so much that large institutions try to build fire-safe buildings and do not install sprinklers. Consequently, water damage from fire fighting is normally catastrophic when a fire does occur.

On a smaller scale, large public library systems, such as the Chicago Public Library, suffer a leaky-roof problem or broken-sprinkler mishap about once every two months in one of their libraries. Each time this happens, an average of 200 volumes are wetted at the Chicago Public Library. When 200 reference books are wetted, the library loses an investment of approximately $20,000, an amount which would more than repay the installed cost of the equipment provided by this invention, that would have saved these books. Up to now, public library systems, such as the Chicago Public Library, must throw away these 200 volumes and replace them with new copies.

A principal object of this invention is to provide an improved process for treating water damaged cellulosic materials and return them, inexpensively, to their original condition.

A further object of this invention is to provide an improved process for treating water damaged cellulosic materials in such a way that they can be straightened or handled during processing to overcome any warpage or deformities which have occurred to the materials by reason of water.

Another object of this invention is to provide a process for the treatment of water damaged cellulosic materials which is economical and which can be practiced with little training and difficulty and at low cost.

Further objects and advantages of this invention will be seen from the following:

GENERAL DESCRIPTION OF THE INVENTION

Generally, the invention contemplates taking water damaged cellulosic materials such as books, periodicals, records, works-of-art on paper, and personal memorabilia and freezing them throughout their extent. This, of course, is carried out at temperatures which are sufficiently low to cause all of the water throughout the extent of the cellulosic materials to be in a frozen condition. After freezing, the conditions are adjusted so that the water sublimes and is removed from the cellulosic materials.

The freezing is desirably conducted under blast freezing conditions which are commercially practiced in various industries, such as the food industry. Generally, such conditions comprise circulation of cold air at temperatures below −50° F. However, slower freezing techniques can be used, so long as all of the water in the cellulosic materials is frozen.

The sublimation of water is most effectively carried out by circulating air at a relative humidity of between about 10 percent and 95 percent in the region of the cellulosic materials, and preferably in the range of 30 percent to 50 percent. The books are desirably dried at temperatures near freezing, i.e., below 30° F. and in the range of between about 20° F. and 30° F. Under drying conditions, the air should circulate around the cellulosic materials at between about 40 cubic feet per minute and 1,000 cubic feet per minute.

The cellulosic materials may be thawed and straightened or otherwise aligned, and then refrozen for drying. Following drying, the books should be gradually warmed to ambient conditions under such conditions as to prevent localized condensation. This is effectively accomplished by slow increase in temperature with circulation of air having low relative humidity.

Cold conditions may be effected by use of dry-ice to substitute or supplement compressors. The evaporating dry-ice provided carbon dioxide which has a number of advantages hereinafter referred to.

The freezing of cellulosic materials can also serve as an effective fumigating technique and functions to kill bugs, larvae, fungi, eggs, rodents and the like. Thus, the freezing can be practiced on low-moisture cellulosic materials without extended drying.

EXAMPLE 1

A commercial freezer was chosen to demonstrate this invention, because the cost of designing and constructing a freezer specifically for treating books would have been prohibitively expensive and possibly have prevented this invention from being made available. The Hussman Refrigeration, Inc., Model UML51BF, self-contained, vertical, glass door, supermarket ice-cream freezer was chosen since its potential capacity for drying books was adequate to cope with minor disasters in libraries. The Model UML51BF vertical unit with a top-mounted evaporator (freezing unit) with glass doors was selected because it provided desired freezing airflow as well as visual control. Moreover, the compressor and condenser compartments were mounted on a slide-out base to facilitate cleaning and servicing. No water drains are required and this freezer can be permanently installed against walls. The refrigeration unit uses low-temperature refrigerant R-502 and has a 1.5 horse-power compressor which provides sufficient cold output for blast (rapid) freezing of cellulosic materials.

Changes were made to convert the freezer into a book-dryer for cellulosic materials that would meet archive, library, and/or museum requirements for safety and efficiency. The factory installed temperature controls were replaced with more accurate and sensitive devices and switches were installed to control the compressor lights, defrost cycle, evaporator fans, and door-frame heaters. The glass doors and the door frames wrere further insulated so that condensation would not occur if the heaters could be turned down or off. The weep (drain) holes in the door gaskets and all openings required tight sealing to prevent entrance of moisture.

Initial tests showed thick books placed inside the modified unit would reach −22° F. within 24 hours and that drying could be effected. Other tests showed the rate of drying improved when the evaporator fans were turned off. Two small plastic fans were installed at the top of the book compartment to suck cold air down from the evaporator compartment to keep the ice in the books in the book compartment from melting.

Approximately 200 books and periodicals were wetted by (1) standing half of them in one inch of water (to simulate a minor flood) and (2) dripping water onto the other half of them (to simulate a sprinkler) for a period of six hours. (This simulation was later found to accurately reflect the consequences of a mishap in a university library).

The books and periodicals were allowed to drain for 30 minutes and were then placed in the freezer. Some of the periodicals were laid flat and others were opened halfway and hung over wooden dowel rods. Some books were laid flat, one on top of another. Other books were splayed open and allowed to stand alone. Additional books were pressed flat dynamically, between two flat plastic plates held with large, strong rubber bands, to prevent sagging and warping as they dried.

As a control, a similar set of control books and periodicals were placed on a nearby table and allowed to air-dry.

The freezer was turned on and operated normally. All books were frozen solid throughout their extent at 10° F. within twelve hours. The temperature controller was reset to hold the compartment temperature between −22° F. and −30° F. The evaporator fans were turned off and the two small plastic fans were turned on. The temperature in the evaporator compartment immediately dropped and subsequently ranged between −30° F. to −45° F., dependent on the amount of hoarfrost which collected on the evaporator. The relative humidity in the book compartment of the freezer was maintained at between 95 percent and 40 percent and the air in the freezer was circulated at 40 cubic feet per minute.

The books and periodicals gradually dried over a period of 30 days. The ice which collected on the evaporator was removed daily by defrost. At the end of the period, the books were dry throughout their extent. The water inside the books had moved by capillary action (water does not freeze inside paper fibers above 20° F.) and as vapor to the evaporator, where it condensed again as ice.

After 30 days drying, the freezer and books were brought back to room temperature by turning off the compressor and turning on the heat sources, i.e., evaporator fans, lights, door and frame heaters. The plastic fans also circulated the air and, together with the evaporator fans, kept cold spots from developing where condensation might occur. After 18 hours, the freezer and books had reached 75° F. and the books were removed and inspected.

The books which were held between the plates dried straight and were ready for reuse. The books which were splayed open had cockled pages which were straightened by pressing while still in a damp-dry stage, just before final dryness was reached. All materials were useable, no pages stuck together, and no mildew occurred.

By comparison, the pages of the control books and periodicals made from coated paper that were dried in air stuck together and could not be separated by any known techniques. Practically all of the control books were stained with mildew. Covers were warped and would have had to be replaced before the books would be suitable for library use again. Pages were cockled and would need to be rewetted, flattened, and straightened before rebinding.

EXAMPLE 2

A Hussmann UML-2BS two-door, supermarket freezer was used and modified. The internal working space, after modification, was approximately 40 cubic feet; externally the unit measured approximately 67½" long by 36½" deep by 81¾" high. The electrical wiring controls and instrumentation of the basic freezer were almost totally redesigned to make the unit suitable for (a) salvaging water-wetted books and (b) exterminating insects in their adult, larval, or egg life form. In addition to rodents, I believe the cycle for (b) alone or in combination with (a) will kill living (not spore) fungi.

Modifications included engineering design, addition of new components, and electrical rewiring. Also they included the manufacture, installation, and trouble shooting of a custom-made control panel (12"×30"×72"). The major components mounted in this control panel were:

1. High and low point compartment temperature controller,
2. 12-point digital-indicating temperature control sensor,
3. Refrigeration and defrost clock cycle control, 4. Time-delay switch to turn compartment and/or evaporator fans on after each defrost cycle.
5. Electrical rheostat to control temperature of door-frame heaters,
6. Variable-speed control switches for front and back compartment fans,
7. Compartment fans low-temperature-limit switch,
8. Maximum-termerature-limit "Defrost Heater" switch with manual reset, and
9. Compartment maximum-temperature buzzer alarm and flashing light, and the fuses, terminal strips, indicator lights, toggle switches, necessary wiring, labeling, and connections to the Hussman unit. The control panel was bolted to the freezer so that it could be moved as one unit.

The components of the control panel were connected to their sensors or functioning devices via holes lined with plastic pipe, through the wall of the freezer. These and other holes were sealed with a pliable, refrigerant plastic sealant.

Five of the thermocouples of the temperature control sensor installed in permanent positions to monitor the evaporator compartment. The seven remaining thermocouples were placed in books and at key points in the book compartment during drying and fumigation cycles.

A ¾" thick, close-cell neoprene foam pad was bonded to the underside of the evaporator pan to maximize the temperature difference between the evaporator and book compartments.

The exterior of the metal door frames were insulated with a ⅛" layer of black, closed-cell neoprene/PVC foam. The triple-pane glass doors were additionally insulated with a ⅛" thick plexiglas sheet.

Four 120 cubic feet per minute (cfm) blowers (two on back wall, two in front of doors) were mounted on the top-most shelf, just under the evaporator pan. These blowers circulate the air down the back and front walls and up the center of the book compartment.

These four book-compartment blowers, as well as the three evaporator fans, were wired for automatic or manual switching. The fan-delay timer operating in the automatic operating mode allowed the compressor to cool the evaporator compartment after a defrost cycle and freeze the water drops which cling to the evaporator assembly, before the fans started and air was mechanically circulated. This timer improved efficiency by eliminating the backwards transfer of water vapor after each defrost cycle which occurred in Example 1. Variable-speed controls provided capability to adjust the rate of air-flow produced by the two front and two back compartment fans to protect fragile papers from being torn.

The modifications provided close control, greater flexibility, and improved safety essential for a freezer dryer/exterminator used for different treatment operations. Approximately 200 water-wetted volumes can be dried in a 15 to 30-day drying cycle. Four to six-hundred volumes can be "cold fumigated" in each three-day extermination cycle.

A number of water-wetted books, ranging in size from large encyclopedias to thin pamphlets, were placed inside the freezer after preparation for drying. Preparation included draining until water stopped dripping, straightening distorted books and placing them between plastic plates held by large rubber bands, inserting synthetic paper extending two inches from the book between boards and fly-leaves and every half-inch throughout the book to wick out water, etc. The wetted books were blast frozen to 10° F. whereupon the temperature was adjusted to warm the books to between 25° F. and 31° F. The temperature in the evaporator compartment was adjusted to range between −45° F. and −60° F. A relative humidity of between about 60 percent and 20 percent was maintained during drying. The air was circulated in the freezer during drying at about 500 cfm. The books dried straight and properly aligned in 16 days.

In another test, a New England town probate record book from 1865 to 1870, measuring about 9 inches by 15 inches by one inch thick, was salvaged in 1983. The book was wetted and frozen during a fire on a cold night in March, 1976. It had been kept frozen since that time because the town authorities did not know how to salvage it. The book was received frozen solid and placed standing in the freezer. The book compartment temperature was set to range between 24° F. to 30° F. The relative humidity was maintained at between 90 percent and 10 percent and the air circulated at about 500 cfm.

After three days, the record book had dried sufficiently that it could support its own weight. The book could also be opened slightly. The boards were opened about six inches and the book stood on its foredge for one day. Then the book was laid on its back. The boards would not lay absolutely flat; one had to be pulled down about one inch with a small piece of pressure-sensitive tape. The book was then dried for three more days before being taken to the binder of the town. This irreplaceable record book was taken apart; each leaf cleaned, repaired, and chemically stabilized, sewn back together, and rebound in a traditional style.

The book could not have been dried in air, except by a skilled conservator, because the leaves would have stuck together. The cover had to be replaced because the boards had swelled and were no longer serviceable. The stabilizing and repairs were made because the town needed to keep this record permanently.

EXAMPLE 3

Two rear doors of a standard semi-trailer freezer truck were purchased and an evaporator compartment, including controls and defrost capability, were built on the inside wall. The compressor and control panel were assembled in a separate component, readily connectable to the evaporator compartment on the rear doors. A self-contained electrical generator for power supply could also have been installed if desired.

Following a disaster at a major library, the rear doors, control panel, compressor assembly, and a generator were air-freighted overnight to a nearby airport. A freezer truck was leased locally and used to bring these items to the scene. The existing doors of the freezer truck were removed and replaced with the special doors. The compressor, control panel, generator, and evaporators were connected and the system started to cool the truck.

Water-wetted books were brought from the disaster scene, and loaded into the truck. The truck was fully loaded with 10,000 books and the freezing process was effected to freeze the water throughout the extent of the books at a temperature of about 0° F. The temperature was then raised to between 20° F. and 30° F. and freezer-drying started. The air was circulated and the relative humidity maintained at between 35 percent and 45 percent. With the built-in freezer on the truck assisting, drying was completed in six weeks.

Following inspection and minor repairs, the books were returned to the library for use. The special equipment was returned at end for use in future disasters, and, after re-installation of its doors, the leased freezer truck was returned to its owner for further use.

EXAMPLE 4

A freezer truck was modified substantially, as in Example 3, with addition of incorporating equipment to use dry-ice for additional cooling in the back doors. The carbon dioxide from the dry-ice produced three benefits. First, it produced additional cooling and caused the freezing stabilizing process to occur faster and minimize the degree of staining and other water-caused damage. Second, the temperature of the evaporator was lowered substantially, thus increasing the rate of drying because the water vapor pressure differential was increased. Third, the area of the evaporator was increased, providing more area whereupon ice could freeze. Fourth, the carbon dioxide vapor being absolutely dry was discharged into the freezer itself, thus producing a positive pressure and, not only reducing the amount of external water in-bleed, but also carrying some moisture away.

EXAMPLE 5

Approximately 620 books were placed in the freezer. The books were stacked on shelves for freezing with at least one-inch space around them for air to circulate. The compressor was turned on, controls set, and, in less than 24 hours, the temperature in the middle of an 18-inch stack of large books (Thomas Register) was −40° F. This temperature was maintained for 24 hours. Then the compressor was turned off and heating sources (fans, lights, and door and frame heaters) were turned on. The freezer and books were brought to room temperature overnight and the "cold fumigated" books removed. No detrimental effects were noted.

This treatment would have exterminated all insects found in libraries, particularly as exposure to a temperature of −10° F. for 24 hours is known to be killing to insects in their adult, egg, and larvae life forms.

EXAMPLE 6

A group of archive records in file folders inside boxes were accidentally wetted when a sprinkler malfunctioned. The records were frozen in boxes and stored at a local cold-storage plant. Subsequently, a group of these frozen boxes of records with their cover removed were dried as described in Example 2.

After 27 days, the compressor was turned off and the heating sources turned on to bring the books and freezer back to room temperature. The records were dry and entirely useable, though somewhat cockled.

The various features of the invention which are believed to be new are set forth in the following claims:

What is claimed is:

1. A process for treating water damaged cellulosic material comprising cooling the cellulosic material throughout its extent to below about the freezing point of water, exposing the cooled cellulosic material to an atmosphere that is unsaturated in water vapor and is generally at ambient pressure, the water vapor-unsaturated atmosphere promoting vaporization of water from the cellulosic material, and maintaining sub-freezing temperatures and a water vapor-unsaturated, generally ambient pressure atmosphere around the cellulosic material until a desired degree of dryness in the cellulosic material is achieved.

2. A process according to claim 1 wherein cellulosic material is cooled to and maintained at a temperature of between about 20° F. and about the freezing point of water, in which temperature range the water within the cellulosic material remains unfrozen and capillary action distributes moisture throughout the cellulosic material as it dries.

3. A process according to claim 2 wherein said cellulosic material is cooled throughout to freeze the water contained therein and is then brought to said temperature range of between about 20° F. and the freezing point of water.

4. A process according to claim 1 wherein said cellulosic material is initially cooled throughout at below about −10° F. for at least about 500 minutes, thereby fumigating the cellulosic materials.

5. A process according to claim 1 wherein said cellulosic material is cooled by blast freezing.

6. A process according to claim 1 wherein subsequent to drying said cellulosic material, the cellulosic material is gradually warmed to ambient temperature in the presence of a flowing stream of gas that is unsaturated in water vapor to prevent localized condensation.

7. A process in accordance with claim 1 wherein said atmosphere is maintained at a relative humidity of between about 10 percent and about 95 percent.

8. A process in accordance with claim 1 wherein said atmosphere is a gas stream having a flow rate of between about 40 and about 1000 cfm.

9. A process in accordance with claim 1 wherein said atmosphere is selected from the group consisting of air, carbon dioxide and mixtures thereof.

10. A process according to claim 1 wherein said atmosphere is maintained at water vapor-unsaturated conditions by continuously withdrawing gases of the atmosphere from the region of the cellulosic material, condensing water vapor from the withdrawn gases at lower temperatures and recirculating the gases from which the water vapor is condensed to the atmosphere in the region of the cellulosic material.

11. A process for treating water damaged cellulosic material comprising cooling the cellulosic material throughout its extent to between about 20° F. and the freezing point of water at which temperature range the water within the cellulosic material remains unfrozen, exposing the cellulosic material to a flowing stream of gas having a relative humidity of between about 10 percent about about 95 percent and a flow rate of between about 40 and about 1000 cfm, the gas stream being at generally atmospheric pressure, the flowing, water vapor-unsaturated gas stream promoting vaporization of water from the cellulosic material, capillary action continuously distributing unfrozen water throughout the cellulosic material, and maintaining the stream of flowing gas and maintaining the temperature until a desired dryness of the cellulosic material is achieved.

12. A process according to claim 11 wherein said cellulosic material is cooled throughout to freeze the water contained therein and then brought to said temperature range of between about 20° F. and the freezing point of water.

13. A process according to claim 12 wherein said cellulosic material is cooled by blast freezing.

14. A process according to claim 11 wherein subsequent to evaporating the water from said cellulosic material, the cellulosic material is gradually warmed to ambient temperature in the presence of a flowing stream of gas that is unsaturated in water vapor to prevent localized condensation.

15. A process in accordance with claim 11 wherein said gas stream is selected from the group consisting of air, carbon dioxide and mixtures thereof.

16. A process for treating damaged cellulosic material comprising cooling the cellulosic material to below about −10° F. and maintaining the cellulosic materials at this temperature for at least about 500 minutes to effect fumigation, maintaining the cellulosic material to below the freezing point of water, and exposing the cellulosic material to an atmosphere that is unsaturated in water vapor and is generally at ambient pressure, and maintaining sub-freezing temperatures and a water vapor-unsaturated, generally ambient pressure atmosphere in the region of said cellulosic material until a desired degree of dryness in the cellulosic material is achieved.

17. A process according to claim 15 wherein said cellulosic material is cooled by blast freezing.

18. A process according to claim 16 wherein subsequent to evaporating the water from said cellulosic material, the cellulosic materials are gradually warmed to ambient temperature in the presence of an atmosphere that is unsaturated in water vapor to prevent localized condensation.

19. A process in accordance with claim 16 wherein said atmosphere in the region of said cellulosic material is a flowing gas stream having a flow rate of between about 40 and about 1000 cfm.

20. A process in accordance with claim 16 wherein said atmosphere has a relative humidity of between about 10 percent and about 95 percent.

* * * * *

UNITED STATES PATENT AND TRADEMARK OFFICE

CERTIFICATE OF CORRECTION

PATENT NO. : 4,543,734

DATED : October 1, 1985

INVENTOR(S) : Richard D. Smith

It is certified that error appears in the above-identified patent and that said Letters Patent is hereby corrected as shown below:

Column 1, Line 49, change "Los Angelos" to --Los Angeles--.

Column 2, Line 8, insert --an-- between "on" and "average".

Column 3, Line 53, change "wrere" to --were--.

Column 4, Line 4, change "library)." to --library.)--.

Column 5, Line 19, "4" should be at margin.

Line 21, change "." to --,-- (comma).

Line 27, change "termerature" to --temperature--.

Column 9, Line 1, delete second occurrence "about".

Signed and Sealed this

*Thirty-first* Day of *December 1985*

[SEAL]

*Attest:*

DONALD J. QUIGG

*Attesting Officer*

*Commissioner of Patents and Trademarks*